US009267363B2

(12) United States Patent
Hallundbæk et al.

(10) Patent No.: US 9,267,363 B2
(45) Date of Patent: Feb. 23, 2016

(54) DOWNHOLE ARTIFICIAL LIFTING SYSTEM

(75) Inventors: Jørgen Hallundbæk, Græsted (DK); Paul Hazel, Aberdeenshire (GB)

(73) Assignee: WELLTEC A/S, Allerod (DK)

( * ) Notice: Subject to any disclaimer, the term of this patent is extended or adjusted under 35 U.S.C. 154(b) by 686 days.

(21) Appl. No.: 13/512,975

(22) PCT Filed: Dec. 3, 2010

(86) PCT No.: PCT/EP2010/068819

§ 371 (c)(1),
(2), (4) Date: May 31, 2012

(87) PCT Pub. No.: WO2011/067372

PCT Pub. Date: Jun. 9, 2011

(65) Prior Publication Data

US 2012/0234556 A1 Sep. 20, 2012

(30) Foreign Application Priority Data

Dec. 3, 2009 (EP) ..... 09177927
Dec. 23, 2009 (EP) ..... 09180568

(51) Int. Cl.
*E21B 43/12* (2006.01)

(52) U.S. Cl.
CPC ..... *E21B 43/123* (2013.01)

(58) Field of Classification Search
CPC ... E21B 43/123; E21B 21/103; E21B 43/121; E21B 43/122
USPC ..... 166/321, 322, 325, 386, 377, 378, 372
See application file for complete search history.

(56) References Cited

U.S. PATENT DOCUMENTS

| | | | | |
|---|---|---|---|---|
| 1,767,201 | A | 6/1930 | Boynton | |
| 2,274,062 | A | 2/1942 | Hays | |
| 2,624,362 | A * | 1/1953 | Church | 137/155 |
| 3,059,700 | A | 10/1962 | Loy, III et al. | |
| 3,342,202 | A | 9/1967 | McMurry et al. | |
| 3,373,805 | A * | 3/1968 | Boberg et al. | 166/303 |
| RE32,441 | E | 6/1987 | Higgins et al. | |
| 5,195,585 | A * | 3/1993 | Clemens et al. | 166/222 |
| 8,820,413 | B2 * | 9/2014 | Mathiesen et al. | 166/373 |
| 2003/0141060 | A1 | 7/2003 | Hailey, Jr. et al. | |

(Continued)

FOREIGN PATENT DOCUMENTS

WO WO 9522682 A1 * 8/1995

OTHER PUBLICATIONS

International Search Report for PCT/EP2010/068819 mailed Apr. 19, 2011.

(Continued)

*Primary Examiner* — Blake Michener
*Assistant Examiner* — Kipp Wallace
(74) *Attorney, Agent, or Firm* — Nixon & Vanderhye P.C.

(57) ABSTRACT

The present invention relates to a downhole artificial lifting system for introducing fluid into a production casing from an annulus arranged outside the production casing. The production casing has an axial extension and a casing wall with a wall thickness, and the system comprises the production casing which at a first part is surrounded by an intermediate casing creating the annulus which is downwardly closed, and a fluid delivering means pumping fluid into the annulus. The invention also relates to a tool for use in the system and a method.

15 Claims, 8 Drawing Sheets

(56) References Cited

U.S. PATENT DOCUMENTS

| | | | | |
|---|---|---|---|---|
| 2004/0055752 | A1* | 3/2004 | Restarick et al. | 166/313 |
| 2006/0027377 | A1 | 2/2006 | Schoonderbeek et al. | |
| 2006/0131033 | A1* | 6/2006 | Bode et al. | 166/386 |
| 2007/0181312 | A1* | 8/2007 | Kritzler et al. | 166/372 |
| 2007/0193752 | A1 | 8/2007 | Kim | |
| 2007/0235197 | A1* | 10/2007 | Becker et al. | 166/372 |

OTHER PUBLICATIONS

International Preliminary Report on Patentability mailed Mar. 6, 2012.

* cited by examiner

DOWNHOLE ARTIFICIAL LIFTING SYSTEM

This application is the U.S. national phase of International Application No. PCT/EP2010/068819 filed 3 Dec. 2010 which designated the U.S. and claims priority to EP 09177927.2 filed 3 Dec. 2009, and EP 09180568.9 filed 23 Dec. 2009 the entire contents of each of which are hereby incorporated by reference.

TECHNICAL FIELD

The present invention relates to a downhole artificial lifting system for introducing fluid into a production casing from an annulus arranged outside the production casing. The production casing has an axial extension and a casing wall with a wall thickness, and the system comprises the production casing which at a first part is surrounded by an intermediate casing creating the annulus which is downwardly closed, and a fluid delivering means pumping fluid into the annulus. The invention also relates to a tool for use in the system and a method.

BACKGROUND

In an oil or gas production well, there might not be sufficient pressure in the reservoir to lift the production fluids to the surface. In such circumstances, artificial lift may be necessary to lift the produced fluids to the surface. In other circumstances, artificial lift may be used in naturally flowing wells which do not technically need it to increase the flow rate to a higher level than the natural rate.

Artificial lift refers to the use of an artificial means to increase the flow of liquids, such as crude oil or water, from a production well. This is generally done by using a mechanical device inside the well, e.g. a pump or a velocity string, or by decreasing the weight of the hydrostatic column by injecting a fluid, often a gas, into the liquid a certain distance down the well. The latter is often referred to a gas lift system.

In a gas lift system, the injected gas aerates the fluid to reduce its density. The formation pressure is thereby able to lift the oil column and force the fluid out of the wellbore. Gas may be injected continuously or intermittently, depending on the producing characteristics of the well and the arrangement of the gas lift equipment.

Accordingly, it is known to use gas lift systems for artificial lift in production wells. Some known gas lift systems consist of a mandrel which is a device installed in the tubing string of a well.

There are two common types of mandrels. In a conventional gas lift mandrel, a gas lift valve is installed as the tubing is placed in the well. Thus, to replace or repair the valve, the tubing string must be pulled up. This is a cumbersome operation.

Another known mandrel is the side-pocket mandrel. In such a mandrel, the valve is installed and removed by means of wireline while the side-pocket mandrel remains in the well. This may eliminate the need to pull up the tubing to repair or replace the valve, however, side-pocket mandrels are complicated to operate and are furthermore installed as the tubing is placed in the well. Moreover, mandrels occupy a lot of space outside the production casing, which complicates other operations performed outside the production casing.

Furthermore, as mentioned above, the known gas lift system is installed in the tubing, i.e. the casing, however, the known gas lift system is difficult or nearly impossible to retrofit into existing production wells.

DESCRIPTION OF THE INVENTION

It is an object of the present invention to wholly or partly overcome the above disadvantages and drawbacks of the prior art. More specifically, it is an object to provide an alternative downhole artificial lifting system with a simple and reliable design.

It is also an object to provide an alternative downhole artificial lifting system which only occupies little space inside and outside the production casing.

Additionally, it is an object to provide an alternative downhole artificial lifting system which may easily be retrieved and replaced.

Furthermore, it is an object to provide an alternative downhole artificial lifting system which may be retrofitted in existing production casings.

The above objects, together with numerous other objects, advantages, and features, which will become evident from the below description, are accomplished by a solution in accordance with the present invention by a downhole artificial lifting system for introducing fluid into a production casing from an annulus arranged outside the production casing, the production casing having an axial extension and a casing wall with a wall thickness, the system comprising:

the production casing which at a first part is surrounded by an intermediate casing creating the annulus which is downwardly closed, and a fluid delivering means pumping fluid into the annulus, wherein the system further comprises at least one inflow control valve having an axial extension, arranged in the first part of the casing wall so that the axial direction of the valve is substantially perpendicular to the axial extension of the casing.

By having an inflow control valve, a more simple system is obtained which is easy to install, both in an existing casing and at the time of installing the casing in the borehole. Furthermore, it makes it possible to obtain a solution which does not change the inside or outside diameter of the casing, which makes it easier to perform subsequent operations.

In an embodiment, the inflow control valve may have an axial extension which is substantially the same or smaller than the wall thickness of the casing.

Furthermore, the system may comprise a plurality of valves.

Moreover, the fluid may have a density lower than that of crude oil.

Additionally, the valves may all be arranged in one level.

In addition, the fluid may be gas.

In one embodiment, the inflow control valve may be a constant inflow control valve providing a constant inflow of fluid into the production casing.

The downhole artificial lifting may further comprise a sliding sleeve arranged opposite the valve, which is able to slide from an open position to a closed position.

Having a slidable sleeve opposite the valve as part of the casing wall allows for closing of the sliding sleeve when the casing is pressurised from within to perform an operation requiring highly pressurised fluid, e.g. when expanding annular barriers. When the operation requiring a high pressure is finalised, the sliding sleeve can be opened, thereby enabling fluid from the annulus to flow into the casing through the valve.

In an embodiment, the sliding sleeve may slide in a recess in the casing and form part of the wall thickness.

Hereby, the inner diameter of the casing is not decreased, which may limit subsequent operations in the well.

In another embodiment, the annulus may be closed by a packer, and a blocking means may be arranged outside the first part, dividing the annulus into a top part and a bottom part, causing the bottom part to be a confined annulus area between the blocking means and the packer.

The blocking means may have a flow providing means for allowing fluid to pass the blocking means.

This flow providing means may be a valve means connectable to the fluid delivering means, allowing the fluid of the fluid delivering means to flow past the top part of the annulus and into the confined annulus area.

Furthermore, the system may comprise a plurality of blocking means to ensure that a first blocking means creates a confined annulus area between the first blocking means and the packer, and that a second blocking means creates a confined annulus area between the first blocking means and the second blocking means.

Additionally, the valve means may be a one-way valve.

Furthermore, the first part of the casing wall may have at least one valve outside each confined annulus area, allowing fluid to flow from that confined annulus area into the production casing through the valve.

The downhole inflow control valve may comprise a housing having an inlet and an outlet; a piston element sliding within the housing, comprising a face and at least one side abutting the housing and extending from the face towards the outlet of the housing, the face facing the inlet and having a piston hole allowing the fluid from the inlet to flow through the piston hole and out through the outlet; and a spring element arranged between the housing and the piston, wherein the side of the piston element is able to, at least partly, close the outlet in order to reduce the inflow of fluid into the casing.

Moreover, the inflow control valve may comprise a fastening means for fastening the valve to an opening in the casing.

This fastening means may comprise a thread or a plurality of projecting parts for projecting into a groove in a hole in a wall of the casing, such as a bayonet lock.

Furthermore, the inflow control valve may comprise a unique identifier, such as a chemical or radioactive tracer.

Additionally, the inflow control valve may comprise a gas detection means, a water detection means or a density detection means which is able to close the valve if the density is lower or higher than a predetermined density.

This gas or water density detection means may comprise closing means for closing the outlet or the inlet.

In one embodiment, the valves may be controllable from above the well.

In another embodiment, the valves may be remotely controllable from above the well.

The gas may flow directly into the production casing through the valve.

In an embodiment of the invention, the inflow control valve may have a height and a diameter, and the height is substantially equal to the wall thickness of the casing.

In another embodiment of the invention, the inflow control valve may be connected directly or indirectly to the delivering means.

By directly is meant by means of a tubing or the like flow transpotable means, and by indirectly is meant that the valve is in fluid communication with the delivering means, e.g. through of the annulus.

The delivering means may be submerged into the intermediate casing on the outside of the production casing.

Furthermore, the delivering means may have a tubing part for connection with the valve.

The inflow control valve may comprise a connection means for connection with the tubing part of the delivering means.

In one embodiment, the system may further comprise a tool for placing a valve in a casing, the tool comprising a milling means for creating an opening in the casing wall.

In another embodiment, the tool may comprise a means for punching a hole in the casing and subsequently inserting the valve into the hole, e.g. by means of a self-tapping arrangement on the outside of the valve.

The tool may further comprise a means for creating a fastening recess or threads in the opening or an insertion means for inserting a valve into the opening.

Furthermore, the system may comprise a tool for retrieving a valve in a casing wall, the tool comprising a key means for inserting into a recess in the valve and for unthreading the valve, or for releasing the fastening means of the valve in order to retrieve the valve.

This invention also relates to a method for fitting a downhole inflow control valve into an existing production casing downhole, the casing having a casing wall, the method comprising the steps of:

- introducing a tool into the casing and lowering the tool to a predetermined position,
- providing an opening in the casing wall,
- inserting the downhole inflow control valve into the opening, and
- fastening the downhole inflow control valve to the casing wall.

The opening may be provided with fastening means, such as a thread, enabling the fastening of the valve to the casing wall to be performed by screwing the valve into the casing wall, or the opening may be provided with fastening means, such as a mechanical locking means, which is adapted to correspond with corresponding locking means on the valve.

The invention furthermore relates to a method for replacing a downhole inflow control valve in a production casing downhole, the casing having a casing wall, the method comprising the steps of:

- introducing a tool into the casing and lowering the tool to the valve to be replaced,
- unfastening the valve from the casing wall,
- retrieving the valve from the casing and thereby exposing an opening in the casing wall,
- inserting a new valve into the opening, and
- fastening the new valve to the casing wall.

Additionally, the invention relates to a method for providing an artificial lift in a well downhole using at least one inflow control valve in a production casing downhole, the production casing being enclosed by an intermediate casing creating an annulus, the method comprising the steps of:

- connecting a fluid delivering means with the annulus,
- pumping fluid into the annulus by means of the fluid delivering device,
- wherein the fluid has a density lower than that of crude oil or is gas, and
- opening the inflow control valve being connected to the annulus, allowing the fluid to enter through the inflow control valve into the production casing, whereby the fluid in the production casing starts to flow, or flows faster.

Moreover, the invention relates to a method for detecting during production a position of a specific downhole inflow control valve among a plurality of inflow control valves arranged spaced apart in a casing wall of a casing downhole, wherein each valve comprises a unique identifier, the method comprising the steps of analysing a fluid for the purpose of locating the existence of unique identifiers, comparing the analysis of the fluid with the unique identifier of each valve, and determining the specific valve based on the comparison.

Finally, the invention relates to a tool for use in the system described above for placing a valve in a casing, the tool comprising:

- a milling means, such as a milling head, for creating an opening in the casing wall,
- a means, such as a miller, a tap or a thread maker, for creating a fastening recess or threads in the opening, and
- an insertion means for inserting a valve into the opening.

BRIEF DESCRIPTION OF THE DRAWINGS

The invention and its many advantages will be described in more detail below with reference to the accompanying schematic drawings, which for the purpose of illustration show some non-limiting embodiments and in which.

All these figures are highly schematic and not necessarily to scale, and they show only those parts which are necessary in order to elucidate the invention, other parts being omitted or merely suggested.

DETAILED DESCRIPTION OF THE INVENTION

Figure 8:
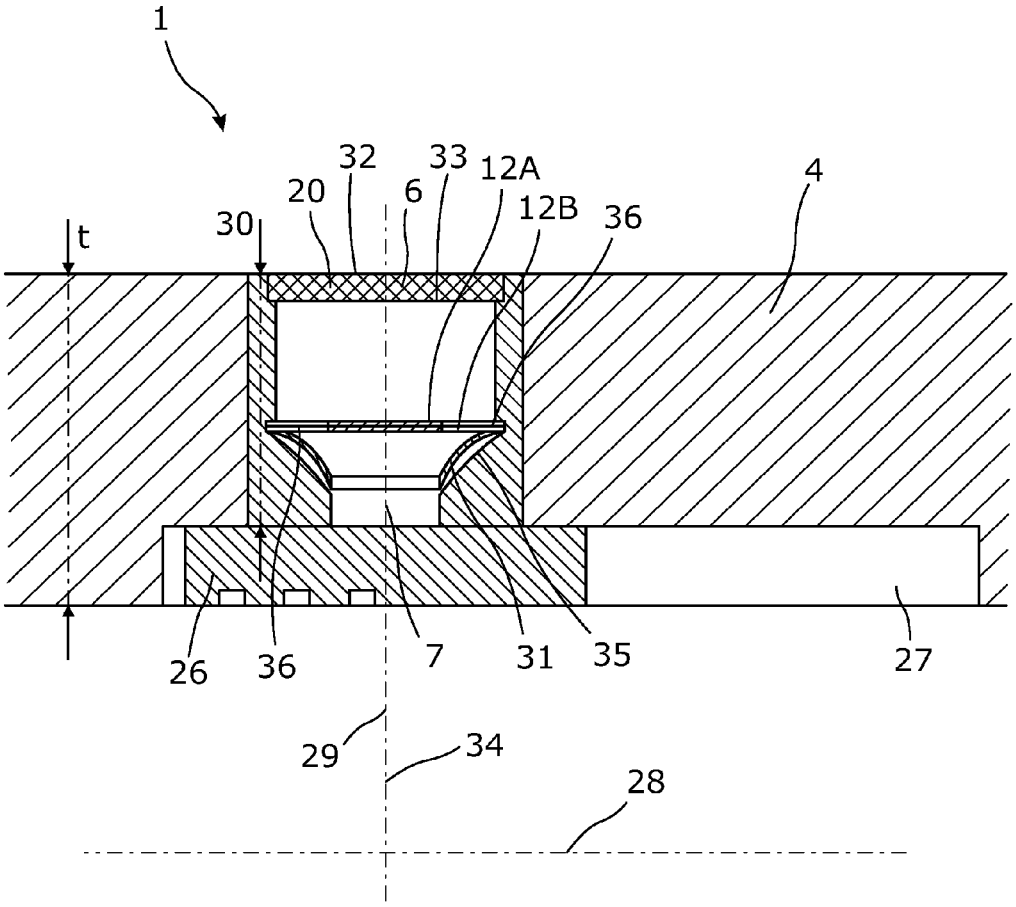
FIG. 8 shows yet another embodiment of the inflow control valve.

The invention relates to a downhole artificial lifting system 100 for introducing fluid into a production casing 4 from an annulus arranged outside the production casing. The production casing 4 has a casing wall 102 with a wall thickness t. The downhole system 100 comprises the production casing 4 which at a first part 107 is surrounded by an intermediate casing creating the annulus which is downwardly closed, and a fluid delivering means 108 pumping fluid into the annulus. The casing 4 has an axial extension 29, which is indicated by a dotted line in FIG. 1. The system 100 further comprises at least one inflow control valve 1 arranged in the first part 107 of the casing wall 102, having an axial extension 29 which is substantially the same as or smaller than the wall thickness t, as shown in FIG. 8. The valve 1 is arranged substantially perpendicular to the axial extension 29 of the casing 4, and thereby does not extend into the casing, meaning that the passage in the casing remains unchanged after insertion of the valve.

Having an inflow control valve 1 prevents the thickness of the casing 4 from increasing, which makes other operations easier. Furthermore, the complicated prior art solution of having a valve incorporated in a surrounding mandrel is no longer the only solution. In addition, an inflow control valve makes it possible to easily mount valves and thus the system into an existing well, and to easily replace the valve later on if necessary. It is possible to make a completion without the valves 1 to keep the cost at the lowest level possible, and when artificial lift, such as gas lift, is required, the valves may easily be inserted from within the casing 4 by means of a downhole tool. Thus, the downhole system makes it possible to delay the insertion of a valve to a later stage, e.g. after production of hydrocarbons has taken place and money has been earned.

Figure 1:
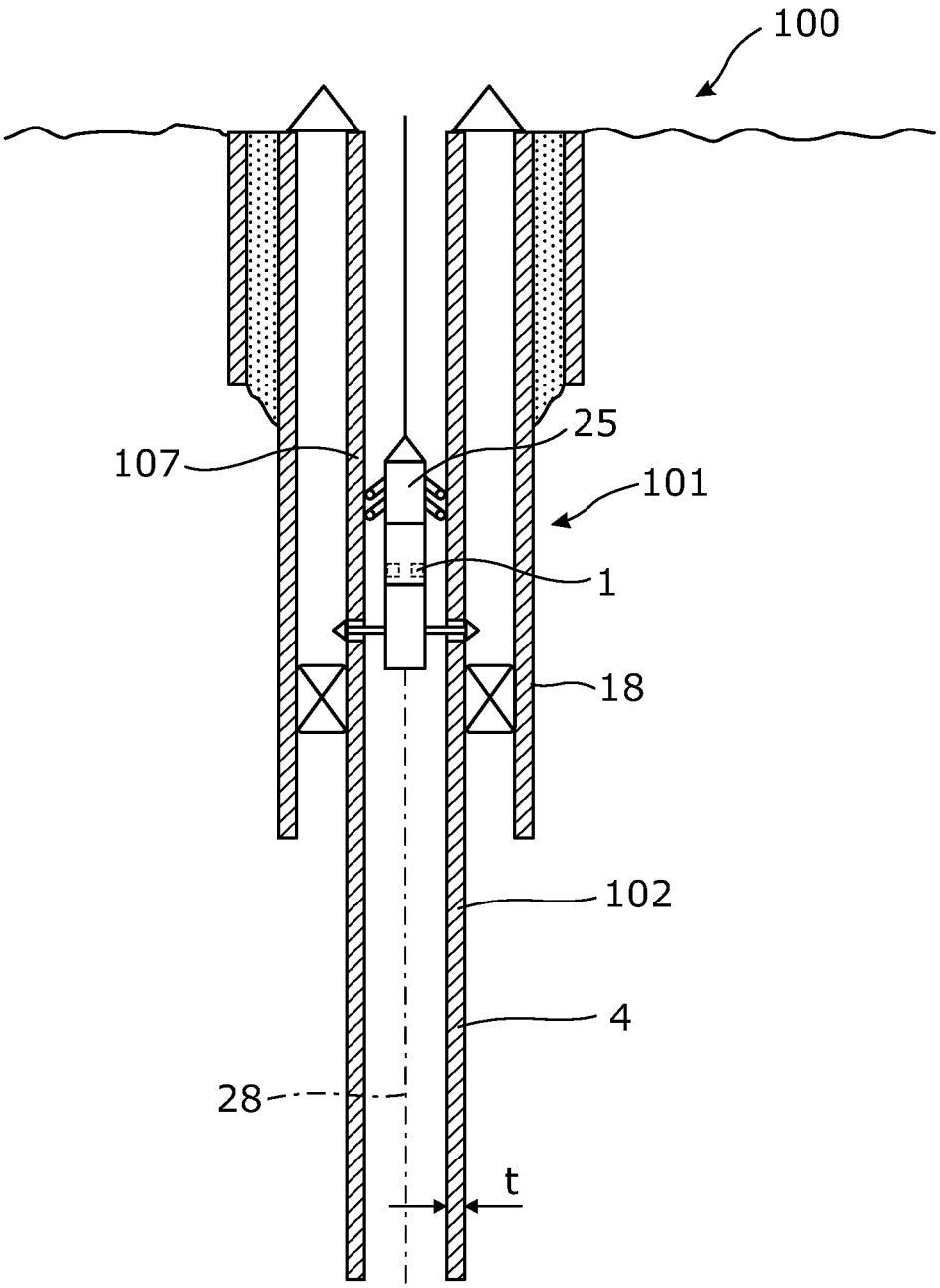
FIG. 1 shows a downhole artificial lifting system according to the invention, creating an opening in the casing.

As shown in the system of FIG. 1, the casing 4 is a production casing enclosed by a surrounding intermediate casing 18, and the fluid which is pumped down into the intermediate casing 18 and into the valves of the production casing is gas. Packers 19 are arranged between the production casing 4 and the intermediate casing 18.

FIG. 1 shows a downhole artificial lifting system 100 according to the invention, creating an opening 103 in the casing 4 in order to insert an inflow control valve 1. A downhole tool 101 comprising a milling means 106 is inserted into the first part 107 of the production casing 4. The tool 101 comprises a downhole tractor which controls and moves the milling means 106 into position and maintains them in position while creating the opening 103 in the well. The milling means 106 may also be held in place by an anchor section which is submerged into the well without the use of a downhole tractor.

In order to be able to fasten the valve 1 in the opening, the milling means 106 may comprise a means, such as a miller, a tap or a thread maker, for creating a recess in the opening 103, enabling the projecting fastening means 13 of the valve 1 to unfold in this recess and thus be fastened. In another embodiment, the tool 101 comprises a means for creating a thread in the opening 103, allowing the valve 1 to be mounted by screwing it into the opening.

Figure 2:
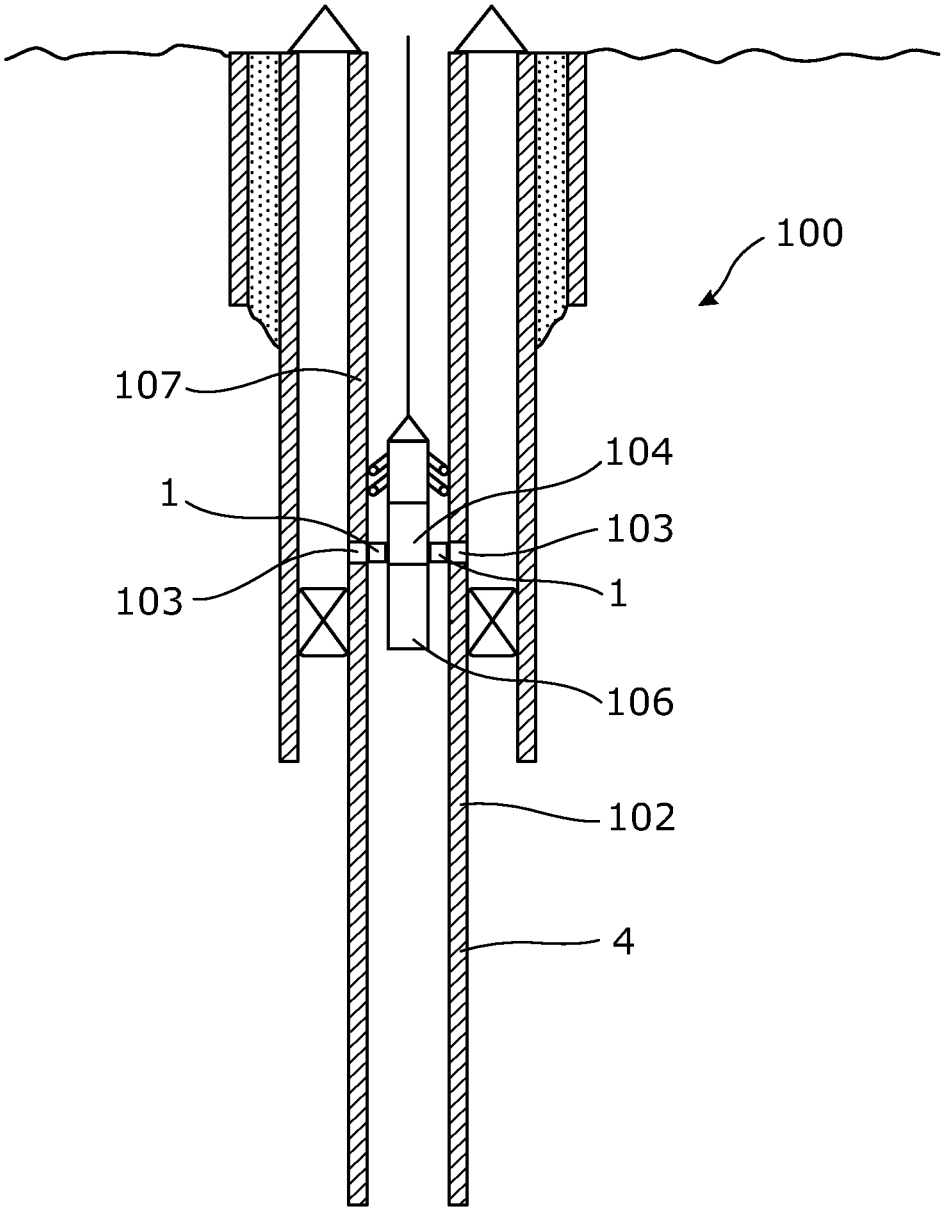
FIG. 2 shows another embodiment of the system inserting an inflow control valve.

When the opening 103 has been created, the tool 101 is moved so that the insertion means 104 is positioned outside the opening, enabling mounting of the valve 1 in the opening, as shown in FIG. 2.

Figure 3:
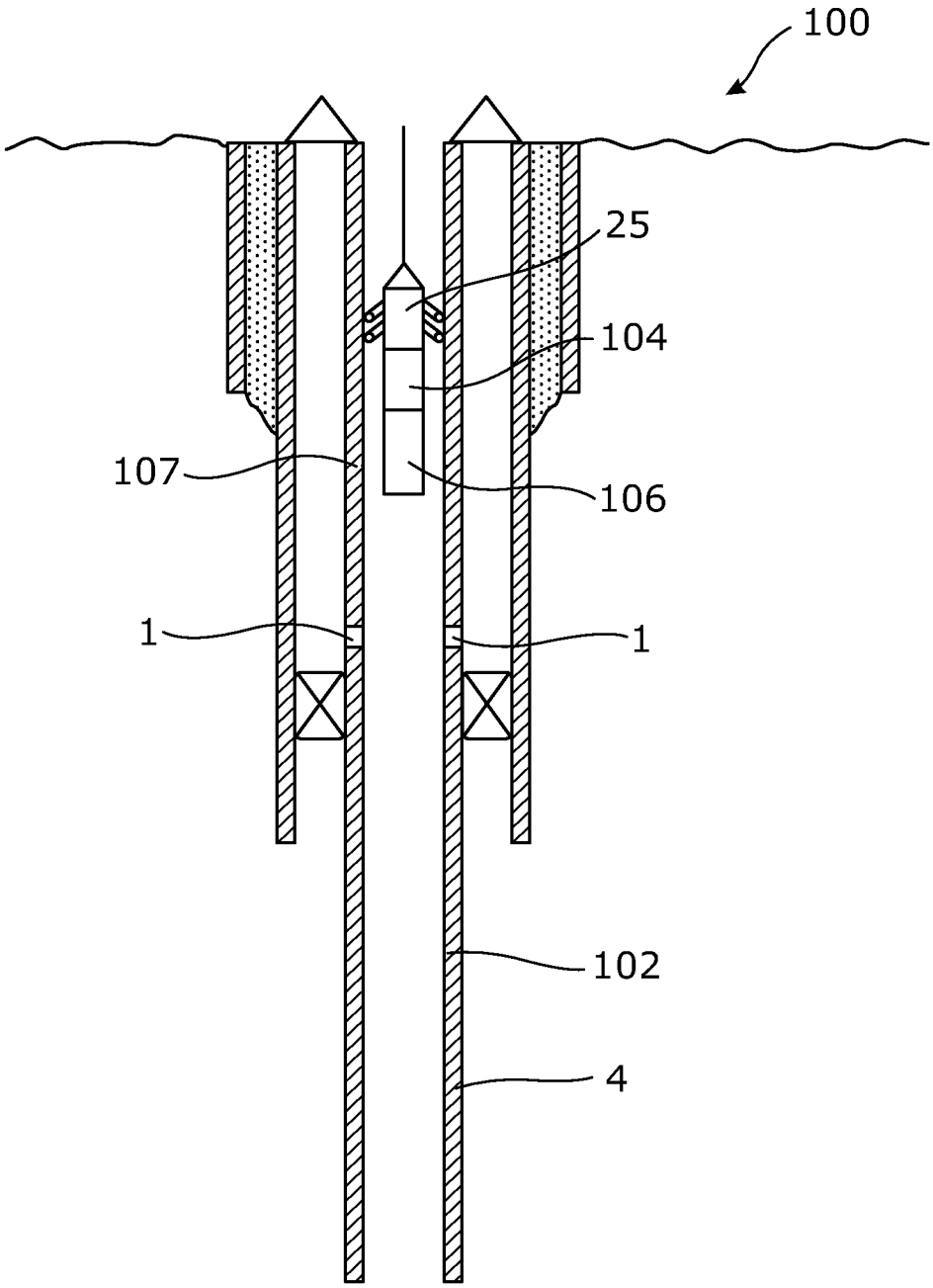
FIG. 3 shows yet another embodiment of the system with the inflow control valve inserted.

FIG. 3 shows yet another embodiment of the system where the inflow control valve 1 has been inserted and the tool is being retracted from the well. The well is now ready for performing artificial lift by pumping gas down into the annulus between the intermediate casing 18 and the production casing 4. The gas enters the production casing 4 through the inflow control valves 1, and the gas is thus pumped into the fluid in the form of bubbles, causing the weight of the hydrostatic column in the first part 107 of the well to decrease. In this way, the flow of the well fluid is initiated, or the well fluid already flowing is accelerated.

By having an inflow control valve 1, the inflow of lifting fluid is controlled to obtain an optimal mix with the well fluid, and thereby an optimal artificial lift of the well.

As can be seen in FIGS. 1-3, the annulus is closed by a packer 110 dividing the production casing 4 into a first 107 and a second part, causing the first part of the production casing to be positioned above the packer. To ensure that the annulus above the packer 110 is not filled with lifting fluid, such as gas, a blocking means 109 is arranged outside the first part 107 of the production casing 4, dividing the annulus into a top part 113 and a bottom part 114, causing the bottom part to be a confined annulus area 115 between the blocking means 109 and the packer 110. In order to perform artificial lifting of the well, only the smaller confined annulus area 115 has to be filled with lifting fluid. Therefore, the blocking means 109 has a flow providing means 112 for allowing fluid to pass the blocking means, and a tubing is connected between a gas delivery means 108 and the flow providing means 112 in order to fill the confined annulus area 115.

Figure 10:
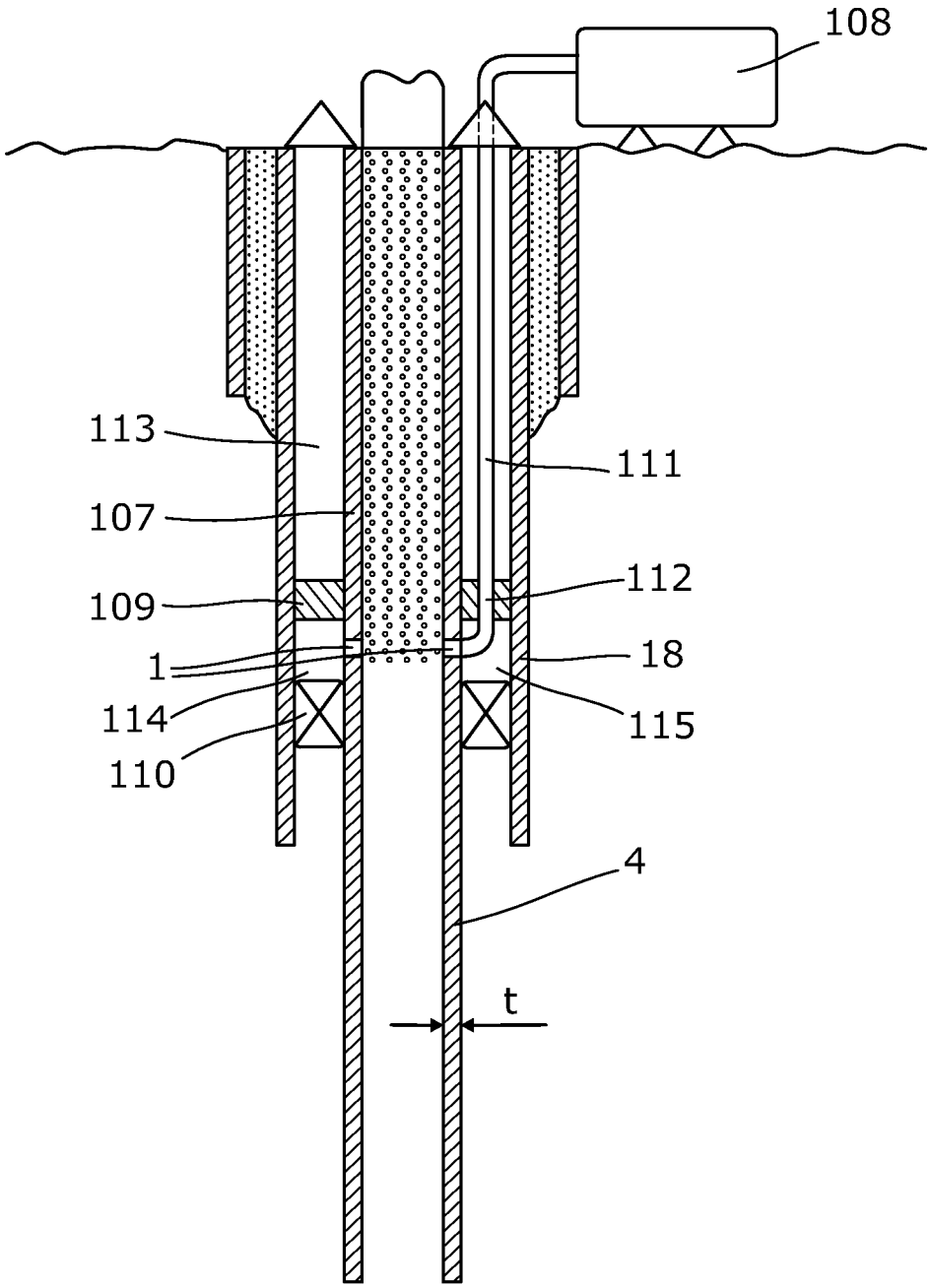
FIG. 10 shows another embodiment of the system performing artificial lift in a well.

In FIG. 10, one of the inflow control valves 1 is connected to a tubing, and gas is thereby provided directly from the gas delivery means 108 into the valve, meaning that the blocking means 109 is no longer necessary, but may be used to hold the tubing in place.

The system 100, 115 comprises a plurality of blocking means 109 so that a first blocking means creates a confined annulus area between that blocking means and the packer 110, and a second blocking means creates a confined annulus area between the first blocking means and the second blocking means. When having several confined areas, the first part 107 of the casing wall 102 has at least one valve 1 outside each confined annulus area 115, enabling fluid to flow from that confined annulus area into the production casing 4 through the valve.

The system 100 may comprise a plurality of inflow control valves 1 positioned in the same level, spaced apart along the diameter of the casing 4. In another embodiment, the valves 1 are arranged spaced apart along the longitudinal extension of the casing 4.

The inflow control valve 1 of the system 100 may be the valve described below in connection with FIGS. 4-7, or it may have other designs and configurations as long as it is able to control the inflow of fluid, and as long as it has an extension which is substantially the same as the wall thickness t of the production casing 4.

The downhole artificial lifting system 100 may comprise a screen 20 through which the fluid flows before entering the inflow control valve 1. In this way, the fluid is slowed down and large solid elements are prevented from entering the valve. On the inside of the production casing 4 outside the outlets 7, the system 100 may have a sleeve which is able to close off the outlet 7 of the valve 1.

The inflow control valve 1 of the system 100 may also comprise a chamber filled with a unique identifier.

Furthermore, the system 100 may comprise a control means for controlling the closing of each valve 1 from the surface. The system 100 may also comprise a tool 101 which is inserted into the casing 4 in order to close the outlets 7 of the valves 1.

Moreover, the system 100 may comprise a means for replacing a valve 1. In this embodiment, the system comprises a tool 101 for retrieving the valve 1 in a production casing wall 102, which tool comprises a key means 105 for being inserted into a recess in the valve and for unthreading the valve, or for releasing the fastening means 13 of the valve in order to retrieve the valve. In order to release the fastening means 13, the key means 105 has to retract a sleeve retracting the projecting fastening means, which has unfolded in the recess, back into the valve, and the valve can then be retracted from the opening in the casing wall 102. Furthermore, the system 100 comprises an insertion means 104 for inserting a valve 1 into the opening 103.

Accordingly, when replacing a downhole inflow control valve 1 in a production casing 4 downhole, the casing having a casing wall 102, a tool 101 is introduced into the production casing and lowered to the valve to be replaced. The valve 1 is then unfastened from the production casing wall 102 and retrieved from the casing 4, causing an opening in the casing wall to be exposed. Subsequently, a new valve 1 is inserted in the opening 103 and fastened to the production casing wall 102.

By well fluid present in the well before performing a gas lift is meant any type of fluid which may be present in oil wells, such as oil, oil mud, crude oil, water etc. By oil is meant any type of oil composition, such as crude oil, an oil-containing fluid etc. Oil and water fluids may therefore all comprise other elements or substances than oil and/or water, respectively. The fluid may also be a combination of gas, oil, water and small solids in the fluid.

By fluid for performing the gas lift operation by forcing this fluid into the production casing gas is meant any type of gas composition or fluid having a density lower than that of crude oil.

By a casing 4 is meant all types of pipes, tubings, tubulars etc. used downhole in relation to oil or natural gas production.

Figure 4:
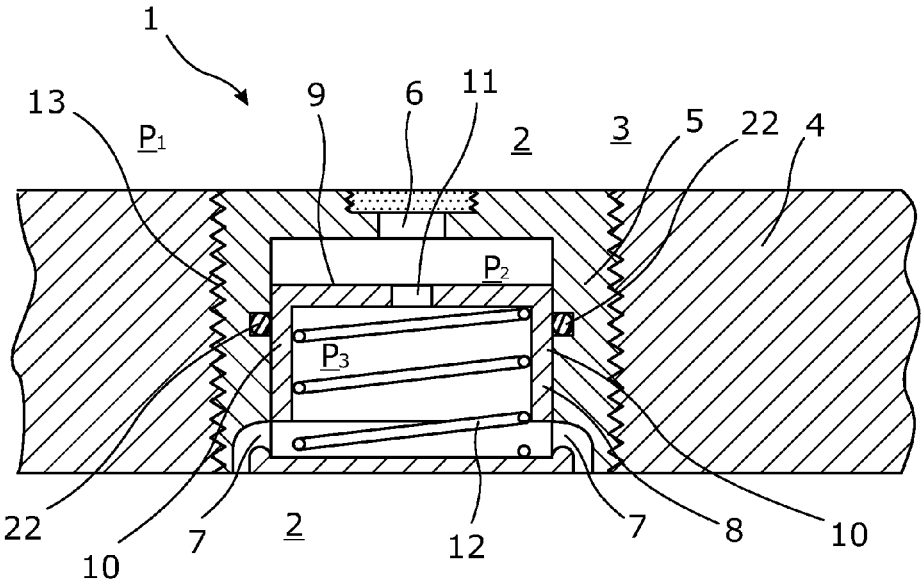
FIG. 4 shows a cross-sectional view of the inflow control valve.

The downhole inflow control valve 1 comprises a housing 5 having an inlet 6 and an outlet 7. As can be seen in FIG. 4, the housing 5 is arranged in the casing wall 102 by means of a threaded connection 13 and has substantially the same extension as the wall thickness t of the production casing 4.

Inside the housing 5, a piston element 8 is arranged which slides back and forth to narrow the outlet hole of the housing 5. The piston element 8 comprises a face 9 facing the inlet 6 of the housing 5. The piston element 8 further comprises a side 10 abutting the inside of the housing 5 and extending from the face 9 towards the outlet 7 of the housing 5. The face 9 has a piston hole 11 allowing the fluid from the inlet 6 to flow through the piston hole 11 and out through the outlet 7 of the housing 5. The valve 1 further comprises a spring element 12 arranged between the housing 5 and the piston 8, wherein the side 10 of the piston element 8 is able to, at least partly, close the outlet 7 in order to reduce the inflow of fluid into the casing 4 and thus reduce the flow rate of the fluid.

By having a piston element 8 moving inside the valve housing 5, a self-actuated valve 1 with a very simple design, which is able to control the inflow of fluid, is obtained. This simple design makes the valve easier to manufacture, and furthermore, it may cause fewer parts to fail when the valve 1 is inserted downhole. When inserting the inflow control valve 1 downhole, the valve 1 must be easy to mount, which is not the case when holes of the valve have to be aligned with existing holes. The inflow control valve 1 is easily installed in an existing production casing 4 by milling a hole in the casing with a threaded connection 13, and the valve can then be installed without any further alignments.

The housing 5 has a first 14, a second 15 and a third 16 wall, and the second wall 15 is arranged between the first 14 and the third wall 16, ensuring that the first 14 and the second wall 15 do not abut one another. The inlet 6 is arranged in the first wall 14 of the housing 5, and the outlet 7 is arranged in the abutting second wall 15. The spring element 12 is arranged within the piston 8 and presses against the face 9 of the piston 8 from the outlet 7 towards the inlet 6.

In FIG. 4, the housing is shaped like a hollow cylinder, and the piston 8 is shaped like a hollow cylinder without a bottom. The face 9 of the piston 8 is thus circular, and the side 10 of the piston 8 is a circumferential side extending from the face 9 towards the third wall 16 of the housing 5 and the outlet 7. In another embodiment, the housing 5 may have a square cross-section, meaning that the housing 5 has four second walls 15 between the first 14 and the third wall 16.

Figure 7:
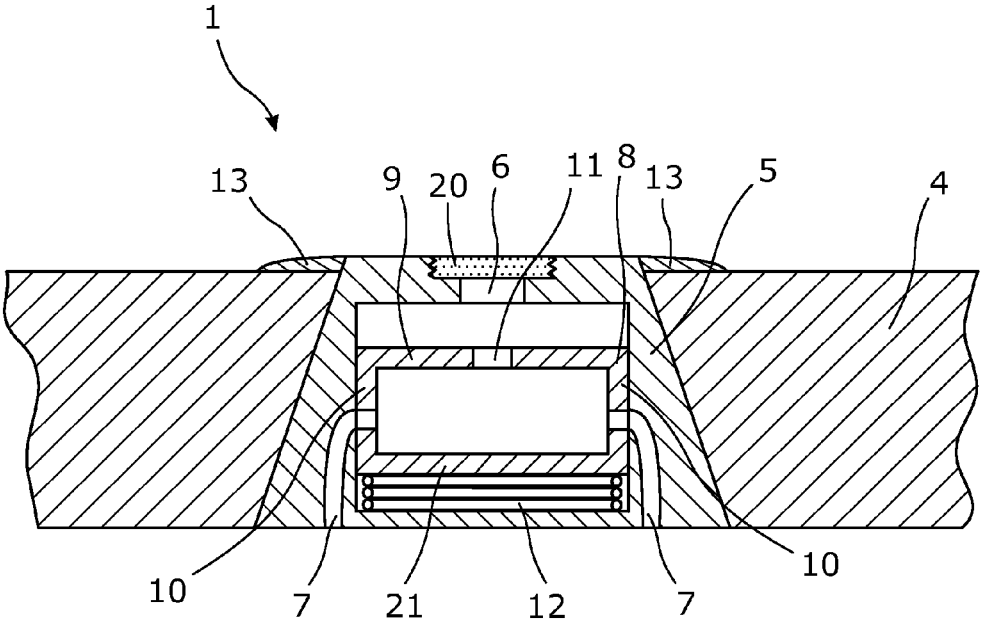
FIG. 7 shows yet another embodiment of the inflow control valve.

In FIG. 7, the side 10 of the piston 8 is also a circumferential side with two openings arranged outside and in alignment with the outlet 7 of the housing 5, enabling the fluid to flow out of the housing 5 and into the production casing 4. If the outlet 7 needs to be narrowed, the side 10 of the piston 8 is displaced away from the inlet 6 in the housing 5. This embodiment has the advantage that if the pressure in the annulus drops because the inlet 6 is blocked by e.g. debris, or if the filter or screen is blocked, the spring element 12 forces the piston 8 towards the inlet 6, whereby the outlet 7 is closed.

On the outside of the side 10 of the piston 8, between the opening and the end farthest away from the piston face 9, the side 10 of the piston 8 is arranged with a barb or a projection which enters the outlet 7, causing the piston 8 to be unable to move downwards again. The barb or projection is maintained inside the wall of the piston side 10, and when possible, it swings outwards towards the outlet opening.

In this way, the inflow control valve 1 is permanently closed, which makes it possible to arrange a new valve elsewhere in the casing wall 102, or to replace the valve. If the valve was not locked, and the feature blocking the flow passage over time was removed, the valve would begin to let fluid flow into the production casing 4 again. This is not a desirable situation as it makes optimal management of the production impossible.

The fluid in the annulus has a first pressure, the fluid after passing the inlet 6 has a second pressure, the fluid after passing the piston opening has a third pressure, and the fluid after passing the outlet 7 has a fourth pressure. When the second pressure is greater than the third pressure and a spring force of the spring element 12, the piston 8 is pushed by the second pressure to, at least partly, close the outlet 7. In this way, the valve 1 is able to control the inflow of fluid into the production casing 4.

As can be seen in FIGS. 4-7, the housing 5 comprises a cavity in which the piston 8 slides. The piston 8 divides the housing 5 into two parts; a first cavity part and a second cavity part which still remain one cavity.

The fluid in the annulus has a first pressure $P_1$, the fluid in the first cavity part after passing the inlet 6 has a second pressure $P_2$, the fluid after passing the piston opening in the second cavity part has a third pressure $P_3$, and the fluid after passing the outlet 7 has a fourth pressure $P_4$. When the second pressure is greater than the third pressure and a spring force F of the spring element, the piston 8 is pushed by the second pressure to, at least partly, close the outlet 7.

In FIG. 4, the inflow control valve 1 comprises two outlets 7. In another embodiment, it may comprise more outlets 7.

Figure 5:
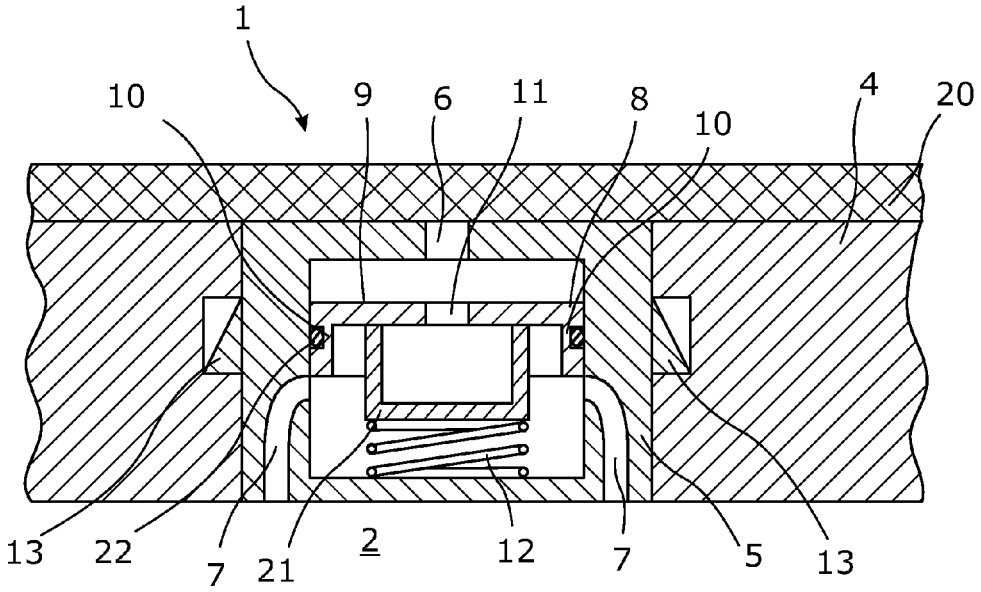
FIG. 5 shows another embodiment of the inflow control valve.
Figure 6:
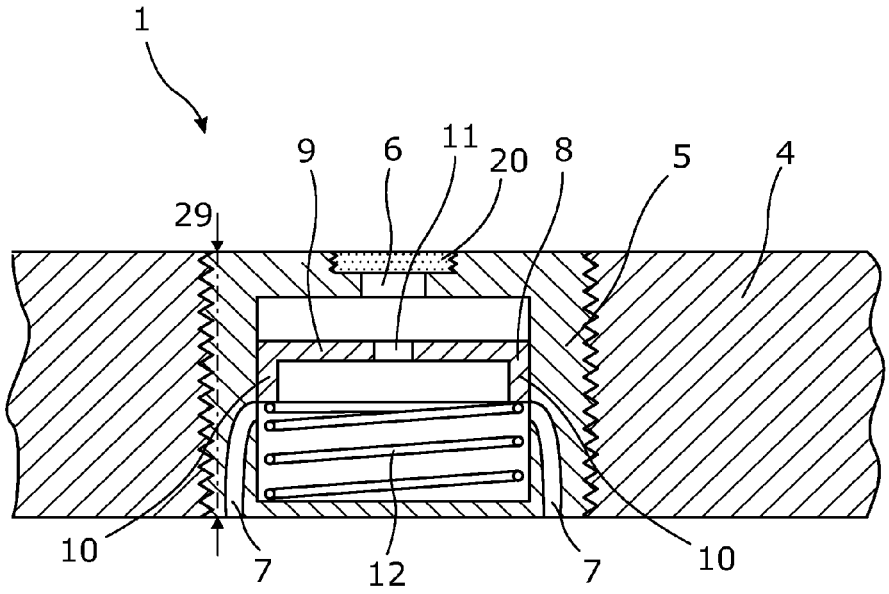
FIG. 6 shows yet another embodiment of the inflow control valve.

In FIGS. 4-6, the spring element 12 is shown as a helical spring. In FIG. 7, the spring element 12 is a disk spring of discs in layers. The spring element 12 may be any kind of suitable spring means, such as a leaf spring or a rubber element.

In FIG. 4, the inflow control valve 1 is fastened to the production casing 4 by means of threads, but it may also have other fastening means 13, such as a plurality of projecting parts for extending into a groove in the casing wall 102. The fastening means 13 may in this way be a bayonet lock. In FIG. 5, the valve 1 has fastening means 13 in the form of projections functioning as barbs when released into the groove in the casing wall 102. The inflow control valve 1 may also have the shape of a tapering cone fitting into a cone-shaped opening in the casing wall 102. In order to fasten the valve 1 when inserted into the production casing 4, the valve is provided with fastening means 13 in the form of arms 13 which are spring-loaded and released when the tip of the valve enters the outside of the casing 4, as shown in FIG. 7. In this way, the inflow control valve 1 is easily insertable into existing wells from within the well.

The piston element 8 slides inside the housing 5, and in order to force the fluid to penetrate only through the piston hole 11, sealing means 22 may be arranged between the piston side 10 and the second wall 15 of the housing 5. The sealing means 22 may be fastened in a circumferential groove in the piston 8, as shown in FIG. 4, or in a circumferential groove in the housing wall, as shown in FIG. 5. The sealing means 22 may be an O-ring or any other suitable sealing means 22.

The inflow control valve 1 may comprise a filter 17 preventing solid elements in the fluid from entering the valve through the inlet 6. The filter 17 is thus arranged in an opening in the housing 5 where it is connected to the housing 5 by means of a threaded connection 13. As shown in FIG. 5, a screen 20 may be positioned on the outside of the production casing 4, causing the fluid to enter through the screen 20 before entering the inlet 6.

In FIG. 5, the piston element 8 has a bottom face fastened to the face 1 by means of bars, pins or the like elongated elements, and the spring element 12 is arranged between the bottom face and the housing 5. The piston element 8 may also be a hollow cylinder or another hollow element having e.g. a square cross-section as shown in FIG. 7. The spring element 12 may be arranged between the third wall 16 of the housing 5 and the bottom of the piston element 21. On the outside of the piston 8, the side 10 may also be barbed or provided with a projection to inhibit a spring force, causing the projection to enter the outlet 7 and thereby closing it.

In FIG. 8, the downhole artificial lifting system 100 comprises a sliding sleeve 26 arranged in a recess 27 in the casing wall, which is able to slide from a closed position to an open position when the inflow control valve is to be used. The sliding sleeve 26 slides along the axial extension 29 of the casing 4, which is perpendicular to the axial extension of the valve 1. Having a sliding sleeve opposite the valve 1 as part of the casing wall allows for closing of the sliding sleeve when the casing 4 is pressurised from within to perform an operation requiring highly pressurised fluid, e.g. when expanding annular barriers. When the operation requiring high pressure is finalised, the sliding sleeve 26 can be opened, thereby enabling fluid from the annulus to flow into the casing 4 through the valve 1.

Figure 9:
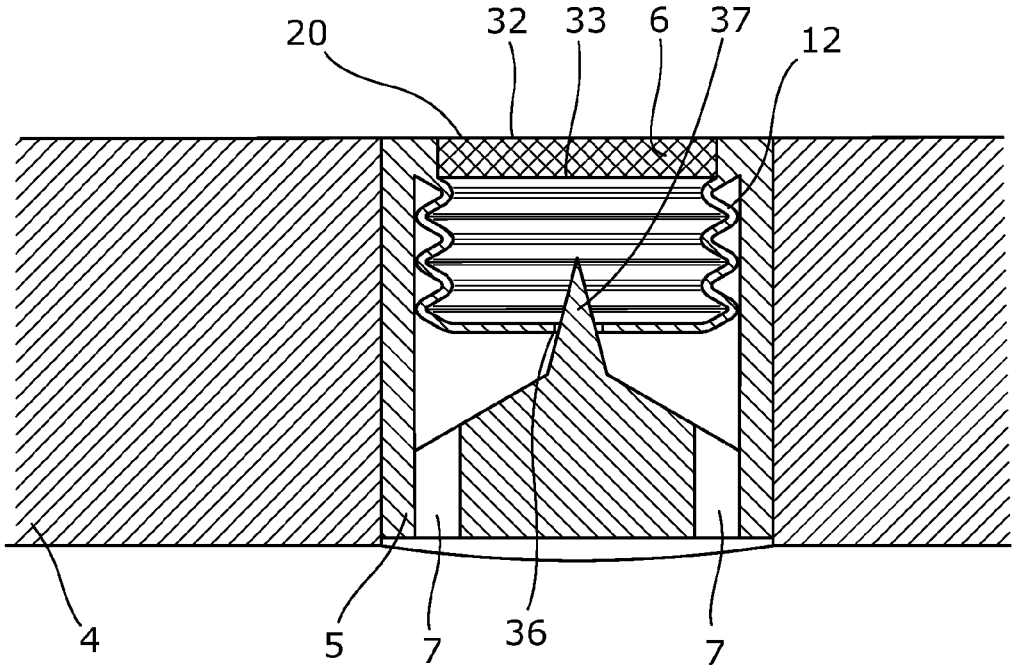
FIG. 9 shows yet another embodiment of the inflow control valve.

Another embodiment of the inflow control valve 1 is shown in FIG. 9. The valve comprises a screen 20 arranged in the inlet 6 of the housing 5 and a spring element 12 in the form of a bellows. The housing 5 has a projection 37 tapering from the end of the housing 5 comprising the outlet 7 towards the inlet 6. The bellows have a valve opening 36 which the projection penetrates so that when the fluid flows in through the inlet 6 of the valve from the formation, the pressure of the fluid forces the bellows to extend causing the valve opening 36 to travel towards the outlets 7, and the valve opening 36 decreases as the bellows travel due to the projection tapering and filling out part of the valve opening 36. In this way, high pressure caused from the fluid pressure in the formation decreases the valve opening, and thus the inflow of fluid is controlled. As the pressure in the formation drops, the bellows are retracted again and more fluid is let through the valve opening 36.

In this way, the inlet of the housing of the valves extends from an outer face 32 of the housing 5 to an inner face 33 of the housing 5 in a radial direction 34 of the casing 4, making it possible to direct the fluid in the radial direction. And the axial extension 30 of the valves is substantially the same as or smaller than the thickness of the casing wall 102.

The inflow control valve 1 comprises a water detection means which closes the valve when the fluid flowing in from the annulus contains too much water. The valve 1 may also comprise a density detection means which detects changes in the density of the fluid, enabling the valve to be closed if the density is lower or higher than a predetermined density.

The valve 1 comprises closing means enabling it to close itself when the fluid reaches a water content which is too high or when the density has changed too much. The valve 1 may also be closed via central control at the surface or by a tool 101 inserted into the production casing 4. By being able to monitor the water content and close the valve when the limit is reached, it becomes much easier to maintain a high quality production.

If the piston element 8 is a hollow element, as shown in FIG. 7, and is provided with barbs or projections on the outside, the closing procedure may be performed by drilling a hole in the bottom of the inflow control valve 1 and subsequently pushing up the piston 8 until the projections unfold in the outlets 7 and thereby close the valve 1.

The closing means of the detection means may comprise a swellable material arranged in the inlet 6 or in another opening through which the fluid flows, causing the swellable material to swell when the fluid contains too much water.

The detection means may also comprise a dissolvable material comprising a unique identifier which is released when the material dissolves. The dissolvable material may be a plastic material containing the identifier.

The water detection means or the density detection means may comprise a unique identifier, such as a chemical or radioactive tracer, which is released when a predetermined limit is reached. In another embodiment, the filter 17 comprises and/or is coated with the unique identifier. In yet another embodiment, the valve comprises a chamber filled with the unique identifier. In this way, each valve can release a unique identifier identifying that specific valve in order to detect which valve needs to be closed to control and optimise production.

The unique identifier may be a hydrophilic identifier which is released when the fluid contains water. The chamber filled with the unique identifier can be opened by means of the water detection means.

In order to detect any identifiers sent by one or several valves 1, the system 100 may comprise means for analysing the fluid for the purpose of locating the existence of unique identifiers.

Thus, if it becomes necessary during production to detect the position of a specific inflow control valve 1 among a plurality of inflow control valves arranged spaced apart in a production casing wall 102 downhole in which each valve has a chamber filled with a unique identifier, a fluid analysis is performed for the purpose of locating any unique identifiers. Subsequently, the fluid analysis is compared with the unique identifier of each valve, and this comparison forms the basis of a determination of the specific valve.

In the event that the tools are not submergible all the way into the casing 4, a downhole tractor 25 can be used to push the tools all the way into position in the well. A downhole tractor is any type of driving tool capable of pushing or pulling tools in a well, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole artificial lifting system for introducing fluid into a production casing from an annulus arranged outside the production casing, the production casing having an axial extension and a production casing wall with a wall thickness (t), the system comprising:

a first part of the production casing being surrounded by an intermediate casing;

the annulus being created between the first part of the production casing and the intermediate casing, the annulus having a first section which is downwardly closed to a well fluid in a downhole well environment, and a lift fluid delivery system configured to pump lift fluid into the first section of the annulus;

wherein the system further comprises at least one inflow control valve having an axial direction, the at least one control valve being removably installed and arranged in the first part of the production casing wall so that the axial direction of the valve is substantially perpendicular to the axial extension of the production casing; and the at least one control valve is configured to be installed and/or replaced from within the wall of the production casing after the production casing has been established down hole.

2. A downhole artificial lifting system according to claim 1, wherein the inflow control valve has an axial extension which is substantially the same or smaller than the wall thickness of the casing.

3. A downhole artificial lifting system according to claim 1, wherein the system comprises a plurality of valves.

4. A downhole artificial lifting system according to claim 3, wherein all the valves are arranged in one level.

5. A downhole artificial lifting system according to claim 1, further comprising a sliding sleeve arranged opposite the valve, which is able to slide from an open position to a closed position.

6. A downhole artificial lifting system according to claim 1, wherein the sliding sleeve slides in a recess within the wall of the production casing and forms part of the wall thickness.

7. A downhole artificial lifting system according to claim 1, wherein the annulus is closed by a packer, and wherein a blocking structure is arranged radially between the production casing and the intermediate casing outside the first part, dividing the annulus into a top part and a bottom part, causing the bottom part to be a confined annulus area between the blocking structure and the packer.

8. A downhole artificial lifting system according to claim 7, wherein the blocking structure has a flow providing bypass structure configured to allow fluid to pass the blocking structure.

9. A downhole artificial lifting system according to claim 1, wherein the system comprises a plurality of blocking structures to ensure that a first blocking means creates a confined annulus area between the first blocking means and the packer, and that a second blocking means creates a confined annulus area between the first and previous blocking means and the second blocking means.

10. A downhole artificial lifting system according to claim 9, wherein the first part of the casing wall has at least one valve outside each confined annulus area, allowing fluid to flow from that confined annulus area into the production casing through the valve.

11. A downhole artificial lifting system according to claim 1, wherein the downhole inflow control valve comprises:

a housing having an inlet and an outlet, a piston element sliding within the housing, comprising a face and at least one side abutting the housing and extending from the face towards the outlet of the housing, the face facing the inlet and having a piston hole allowing the fluid from the inlet to flow through the piston hole and out through the outlet, and a spring element arranged between the housing and the piston, wherein the side of the piston element is able to, at least partly, close the outlet in order to reduce the inflow of fluid into the casing.

12. A downhole artificial lifting system according to claim 1, wherein the system comprises a tool for placing a valve in a casing, the tool comprising:

a milling device configured to create an opening in the casing wall, a fastener creation device configured to create a fastening recess or threads in the opening, and an insertion tool configured to insert a valve into the opening.

13. A method for fitting a downhole inflow control valve into an existing production casing of the downhole artificial lifting system according to claim 1, the production casing having a production casing wall, the method comprising:

introducing a tool into the production casing and lowering the tool to a predetermined position, providing an opening through the production casing wall, inserting the downhole inflow control valve into the opening such that the downhole inflow control valve is removably installed within the production casing wall.

14. A method for replacing a downhole inflow control valve in a production casing of the downhole artificial lifting system according to claim 1, the casing having a production casing wall, the method comprising:

introducing a tool into the production casing and lowering the tool to the valve to be replaced, unfastening the valve from within an opening through the production casing wall, retrieving the valve from within the opening through the production casing wall and thereby exposing the opening through the production casing wall, inserting and removably installing a new valve into the opening through the production casing wall, and fastening the new valve to the production casing wall.

15. A method for providing an artificial lift in a well downhole using at least one inflow control valve removably installed and located within a production casing wall of a production casing of the downhole artificial lifting system according to claim 1, the production casing being enclosed by an intermediate casing, the method comprising:

creating an annulus between the production casing and the intermediate casing by downwardly closing off at least a first section of the annulus from a well fluid in a downhole well environment;

connecting a lift fluid delivering device with the annulus, pumping lift fluid into the annulus via the lift fluid delivering device, wherein the lift fluid has a density lower than that of crude oil or is gas, and opening the removably installed inflow control valve which is configured to communicate with an interior space of the production casing and an interior space of the annulus within the first section, allowing the lift fluid to enter through the inflow control valve into the production casing, whereby the well fluid in the production casing starts to flow, or flows faster.

* * * * *